US008807776B2

(12) United States Patent
Jung et al.

(10) Patent No.: US 8,807,776 B2
(45) **Date of Patent: *Aug. 19, 2014**

(54) BACKLIGHT UNIT FOR DYNAMIC IMAGE AND DISPLAY EMPLOYING THE SAME

(75) Inventors: Il-yong Jung, Suwon-si (KR); Tae-hee Cho, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 12/430,577

(22) Filed: Apr. 27, 2009

(65) Prior Publication Data

US 2009/0213294 A1 Aug. 27, 2009

Related U.S. Application Data

(63) Continuation of application No. 11/410,958, filed on Apr. 26, 2006, now Pat. No. 7,537,357.

(30) Foreign Application Priority Data

Apr. 26, 2005 (KR) ..... 10-2005-0034566

(51) Int. Cl.
*G09F 13/08* (2006.01)
*F21V 9/00* (2006.01)

(52) U.S. Cl.
CPC ..... *F21V 9/00* (2013.01)
USPC ..... 362/97.3; 362/231; 362/244; 345/690; 345/102

(58) Field of Classification Search
CPC ..... G02B 5/00; G02F 5/13; G02F 5/1335; G06F 5/038; G09G 3/30; G09G 3/32; G09G 3/34; G09G 3/36; G09G 5/10; G09F 2/33; H01L 29/00; H01L 27/15; H01L 33/00; H01L 33/08; H01L 25/025; H01L 25/075
USPC ..... 362/30, 33, 97.1, 97.2, 97.3, 97.4, 227, 362/230, 231, 240, 241, 243, 244, 249.01, 362/249.02, 246, 296.01, 330, 343, 511, 362/555, 560, 561, 612, 613, 800, 812; 349/57, 58, 59, 61, 62, 64, 69, 71; 257/79, E25.01, E25.02, E25.73, 257/98–100; 600/109, 118, 160, 178, 181, 600/249; 345/7, 20, 63, 76, 77, 204, 690; 348/65, 68, 74, 76, 222.1, E3.018; 382/217, 218, 254, 274
See application file for complete search history.

(56) References Cited

U.S. PATENT DOCUMENTS 3,875,456 A * 4/1975 Kano et al. ..... 313/501
5,822,053 A 10/1998 Thraikill (Continued)

FOREIGN PATENT DOCUMENTS

DE 10242292 A1 4/2004
EP 1162400 A3 4/2004

(Continued)

OTHER PUBLICATIONS

Search Report issued Mar. 19, 2010 by the European Patent Office.

(Continued)

*Primary Examiner* — Hargobind S Sawhney
(74) *Attorney, Agent, or Firm* — Sughrue Mion, PLLC

(57) ABSTRACT

A backlight unit for a dynamic image and a display employing the same are provided. The backlight unit is used for a light source of a display and includes light-emitting devices located separately on a substrate, an image analyzer which analyzes an image signal and extracts position information on a region requiring the relative increase or decrease of brightness, and a control unit which independently drives and controls the light-emitting devices located in a region corresponding to the position information inputted from the image board. Accordingly, the display employing the backlight unit can provide a more dynamic and realistic image.

24 Claims, 5 Drawing Sheets

(56) References Cited

U.S. PATENT DOCUMENTS

| | | | | |
|---|---|---|---|---|
| 6,177,761 | B1 * | 1/2001 | Pelka et al. | 313/512 |
| 6,200,002 | B1 * | 3/2001 | Marshall et al. | 362/231 |
| 6,236,382 | B1 * | 5/2001 | Kawakami et al. | 345/83 |
| 6,443,597 | B1 | 9/2002 | Natori | |
| 6,547,416 | B2 * | 4/2003 | Pashley et al. | 362/231 |
| 6,857,767 | B2 | 2/2005 | Matsui et al. | |
| 6,858,869 | B2 * | 2/2005 | Fujiwara | 257/79 |
| 6,923,548 | B2 | 8/2005 | Lim | |
| 6,974,229 | B2 * | 12/2005 | West et al. | 362/227 |
| 7,052,152 | B2 * | 5/2006 | Harbers et al. | 362/30 |
| 7,097,337 | B2 * | 8/2006 | Kim et al. | 362/555 |
| 7,140,751 | B2 | 11/2006 | Lin | |
| 7,217,004 | B2 * | 5/2007 | Park et al. | 362/240 |
| 7,252,408 | B2 * | 8/2007 | Mazzochette et al. | 362/294 |
| 7,320,531 | B2 * | 1/2008 | West et al. | 362/231 |
| 7,538,832 | B2 * | 5/2009 | Hong et al. | 349/61 |
| 7,566,160 | B2 * | 7/2009 | Song et al. | 362/613 |
| 7,591,563 | B2 * | 9/2009 | Chou et al. | 362/97.3 |
| 7,893,892 | B2 * | 2/2011 | Tamura et al. | 345/76 |
| 2002/0071288 | A1 | 6/2002 | Lim | |
| 2002/0135298 | A1 * | 9/2002 | Pelka et al. | 313/512 |
| 2002/0159002 | A1 * | 10/2002 | Chang | 349/61 |
| 2003/0052594 | A1 | 3/2003 | Matsui et al. | |
| 2004/0001040 | A1 * | 1/2004 | Kardach et al. | 345/102 |
| 2004/0032388 | A1 | 2/2004 | Tsai et al. | |
| 2004/0061120 | A1 | 4/2004 | Mizuyoshi | |
| 2004/0062040 | A1 | 4/2004 | Blume et al. | |
| 2004/0201987 | A1 | 10/2004 | Omata | |
| 2004/0228127 | A1 | 11/2004 | Squicciarini | |
| 2004/0257329 | A1 * | 12/2004 | Park et al. | 345/102 |
| 2004/0264212 | A1 | 12/2004 | Chung et al. | |
| 2005/0195341 | A1 * | 9/2005 | Koganezawa et al. | 349/62 |
| 2005/0248524 | A1 | 11/2005 | Feng et al. | |
| 2005/0248554 | A1 | 11/2005 | Feng et al. | |
| 2006/0012989 | A1 * | 1/2006 | Lee | 362/231 |
| 2006/0227085 | A1 * | 10/2006 | Boldt et al. | 345/83 |
| 2008/0224977 | A1 | 9/2008 | Park et al. | |

FOREIGN PATENT DOCUMENTS

| | | | | |
|---|---|---|---|---|
| EP | 1 433 877 | A1 | | 8/2004 |
| EP | 1 455 002 | A1 | | 9/2004 |
| JP | 61-84880 | A | | 4/1986 |
| JP | 2000-068562 | A | | 3/2000 |
| JP | 2002099250 | A | * | 4/2002 |
| JP | 2003-016808 | A | | 1/2003 |
| JP | 2003016808 | A | * | 1/2003 |
| JP | 2004-029141 | A | | 1/2004 |
| JP | 2000-353405 | A | | 4/2004 |
| JP | 2004 233809 | A | | 8/2004 |
| JP | 2004-246117 | A | | 9/2004 |
| JP | 2004 246117 | A | | 9/2004 |
| KR | 97-706515 | A | | 11/1997 |
| KR | 1998-076384 | A | | 11/1998 |
| KR | 2002-0019579 | A | | 3/2002 |
| KR | 10-2002-0041480 | A | | 6/2002 |
| KR | 2003 0051898 | A | | 7/2003 |
| KR | 10-2004-0057882 | A | | 7/2004 |
| KR | 2004 0090083 | A | | 10/2004 |
| KR | 2004 0096186 | A | | 11/2004 |
| WO | 2004 049292 | A1 | | 6/2004 |

OTHER PUBLICATIONS

Communication issued Feb. 19, 2011 in counterpart Korean Application No. 10-2005-0034566.

Communication dated Sep. 16, 2011, issued by the State Intellectual Property Office of P.R. China in counterpart Chinese Application No. 200910171906.9.

Communication dated Sep. 6, 2011, issued by the State Intellectual Property Office of P.R. China in counterpart Chinese Application No. 200610072113.8.

Communication dated May 16, 2012 issued by the State Intellectual Property Office of P.R. China in Chinese Application No. 200610072113.8.

Communication dated Aug. 29, 2012 from the State Intellectual Property Office of P.R. China in counterpart Chinese application No. 200910171906.9.

Communication dated Nov. 5, 2012 from the European Patent Office in counterpart European application No. 06113037.3.

Communication dated Oct. 31, 2012 from the European Patent Office in counterpart European application No. 10151334.9.

Communication dated May 21, 2013 issued by the European Patent Office in counterpart European Patent Application No. 06113037.3.

* cited by examiner

BACKLIGHT UNIT FOR DYNAMIC IMAGE AND DISPLAY EMPLOYING THE SAME

CROSS-REFERENCE TO RELATED APPLICATIONS

This is a continuation of U.S. application Ser. No. 11/410,958, filed on Apr. 26, 2006. The entire disclosure of the prior application, application Ser. No. 11/410,958, is hereby incorporated by reference. This application claims priority from Korean Patent Application No. 10-2005-0034566, filed on Apr. 26, 2005 in the Korean Intellectual Property Office, the disclosure of which is also incorporated herein in its entirety by reference.

BACKGROUND OF THE INVENTION

1. Field of the Invention

The present invention relates to a backlight unit and a display employing a backlight unit, and more particularly, to a backlight unit that provides a dynamic image by properly controlling the brightness of light emitting devices that can be driven independently with respect to an image having a large difference of brightness, and a display employing the backlight unit.

2. Description of the Related Art

Liquid crystal displays (LCDs) are used in notebook computers, desktop computers, LCD-TVs, mobile communication terminals, and so on. Since an LCD is a light receiving element type display that cannot emit light by itself, the LCD needs a backlight unit in addition to a liquid crystal panel. The backlight unit is located in the rear of the liquid crystal panel and emits light onto the liquid crystal panel.

The backlight unit can be classified as a direct light type backlight unit and an edge light type backlight unit in accordance with the arrangement of a light source. The direct light type backlight unit irradiates light from a plurality of light sources provided under the liquid crystal panel toward the liquid crystal panel. The edge light type backlight unit emits light from a light source located at a sidewall of a light guide panel (LGP) to the liquid crystal panel. A cold cathode fluorescent lamp (CCFL) is generally used as the light source for the edge light type backlight unit.

Meanwhile, a light emitting diode (LED) is considered as a substitute for the CCFL. For example, LEDs emitting Lambertian light are used as a point light source for the direct light type backlight unit.

Referring to FIG. 1, a conventional backlight unit includes an LED 500, a diffusion plate 503 and a diffusion sheet 505 for projecting light emitted from the LED 500 onto a liquid crystal panel 510 to be uniform, and a reflection plate 502 for reflecting light that is emitted from the LED 500 to proceed toward the liquid crystal panel 510 located above LED 500. Further, a prism sheet 507 is provided to correct a light travelling route between the diffusion sheet 505 and the liquid crystal panel 510 and cause the emitted light to proceed toward the liquid crystal panel 510.

In an LCD, however, a slow response time of the liquid crystal results in a motion blur phenomenon in a fast moving picture. Since the amount of light from a conventional backlight unit is identical over the entire surface of the LCD, an image is monotonous as a whole. For example, for an image that requires a partial increase of the brightness, as in an explosion scene, or an image that requires a partial decrease of the brightness, as in a starlit night sky as a background, there is a limitation in representing the images vividly.

Specifically, eight CCFLs arranged in a line are required for a 26-inch display, and sixteen CCFLs for a 32-inch display. In order to control the brightness, the CCFLs as a line light source need to control each current applied thereto. However, all CCFLs are connected in series and it is impossible to finely control a region needing the increase or decrease of the brightness, even though the CCFLs are driven independently. Consequently, the CCFLs cannot provide a dynamic image.

Also, in the case of a backlight unit using LEDs as a light source, all LEDs are connected and driven in series. Accordingly, it is possible to decrease or increase the overall brightness of LEDs, but it is impossible to increase and decrease the brightness properly.

As described above, because the conventional backlight unit cannot provide an image needing a partial increase or decrease of brightness, it is difficult to provide a dynamic image.

SUMMARY OF THE INVENTION

The present invention provides a backlight unit capable of providing a dynamic image by controlling the brightness of light-emitting devices separately according to image signals.

According to an aspect of the present invention, there is provided a backlight unit for a light source of a display, the backlight unit including: a plurality of light-emitting devices which are disposed on a substrate and driven separately; an image analyzer which analyzes an image signal and extracts position information corresponding to a region of an image requiring a relative increase or decrease of brightness; and a control unit which independently drives and controls light-emitting devices, among the plurality of light-emitting devices, which are located in the region corresponding to the position information which is extracted by the image analyzer.

The control unit may control the brightness of the plurality of light-emitting devices by adjusting a voltage and/or a current applied to the light-emitting devices.

The control unit may control the brightness of the plurality of light emitting devices by supplying a higher or lower voltage or current to the light-emitting devices, among the plurality of light-emitting devices, which are located in the region corresponding to the position information which is extracted by the image analyzer relative to voltage or current which is supplied to light-emitting devices which are not located in the region corresponding to the position information.

The light-emitting devices may include light-emitting diode (LED) chips emitting light having at least two wavelength ranges, and the LED chips are packaged on a base.

The LED chips may be disposed at a periphery of the base.

According to another aspect of the present invention, there is provided a display including: a plurality of light-emitting devices disposed on a substrate and driven separately; an image analyzer which analyzes an image signal and extracts position information which corresponds to a region of an image which requires a relative increase or decrease of brightness; a control unit which independently drives and controls light-emitting devices, among the plurality of light-emitting devices, which are located in the region which corresponds to the position information which is extracted by the image analyzer; and a display panel which displays an image using light emitted from the plurality of light-emitting devices.

BRIEF DESCRIPTION OF THE DRAWINGS

The above and other aspects of the present invention will become more apparent by describing in detail exemplary embodiments thereof with reference to the attached drawings in which.

DETAILED DESCRIPTION OF THE EXEMPLARY EMBODIMENTS OF THE INVENTION

Exemplary embodiments of the present invention will be described in detail with reference to the accompanying drawings.

Figure 1:
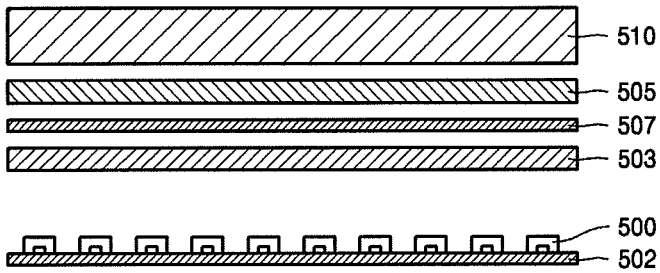
FIG. 1 (PRIOR ART)
FIG. 1 is a sectional view of a conventional direct light type backlight unit.
Figure 2:
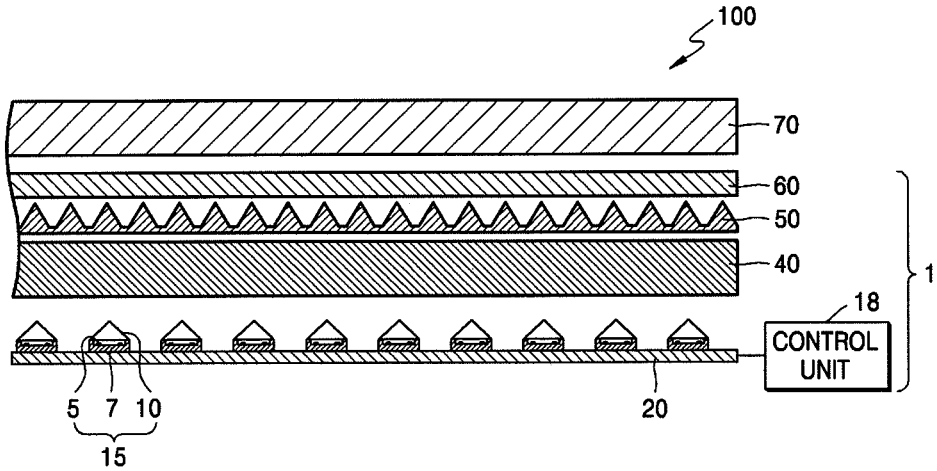
FIG. 2 is a sectional view of a display according to an exemplary embodiment of the present invention.

FIG. 2 is a sectional view of a display according to an exemplary embodiment of the present invention.

Referring to FIG. 2, a display 100 includes a display panel 70 for displaying an image and a backlight unit 1 for providing light to the display panel 70.

A liquid crystal display (LCD) can be used as the display panel 70. The LCD includes thin film transistors and electrodes in each pixel and displays an image. An electric field is applied to liquid crystals in units of pixels according to an image signal inputted from an image signal processor (not shown), and light emitted from the backlight unit 1 is space-modulated. Through these procedures, an image is displayed.

The backlight unit 1 includes a plurality of light-emitting devices 15 arranged two-dimensionally on a PCB substrate 20 and a control unit 18 controlling the light-emitting devices 15. The light-emitting devices 15 are driven electrically and separately and the control unit 18 controls the driving of the light-emitting devices 15. Also, a diffusion plate 40 and a prism sheet 50 are located between the light-emitting devices 15 and the display panel 70. The diffusion plate 40 uniformly projects the light emitted from the light-emitting devices 15 onto the display panel 70. The prism sheet 50 corrects a light travelling path and guides the light toward the liquid crystal panel 70. A polarization enhancement film 60 may be further provided between the prism sheet 50 and the display panel 70. The polarization enhancement film 60 enhances a polarization property to improve an optical efficiency.

Figure 3:
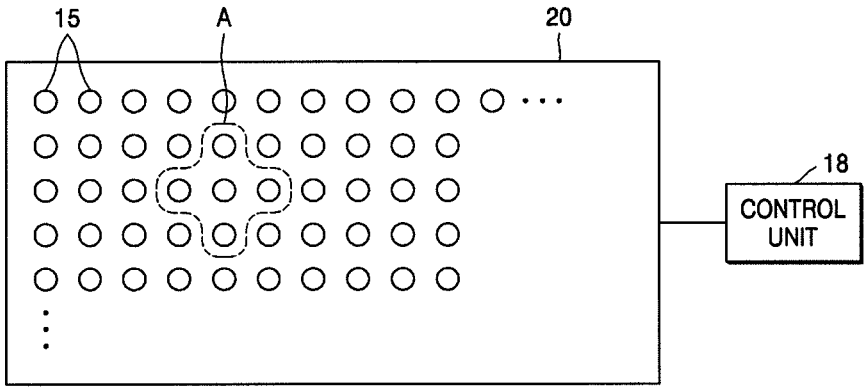
FIG. 3 is a view illustrating the arrangement of multi-chip light emitting devices used in a display and a backlight unit according to an exemplary embodiment of the present invention.

As shown in FIG. 3, the light-emitting devices 15 are arranged two-dimensionally on the PCB substrate 20. A larger number of light-emitting devices 15 provide a higher resolution. The light-emitting devices 15 are formed on the PCB substrate 20 such that current is separately supplied to the PCB substrate 20. In addition, the control unit 18 controls current or a voltage for the light-emitting devices 15. For example, the brightness of the light-emitting devices included in a region A of FIG. 3 can be increased or decreased more than that of the other light-emitting devices by supplying relatively higher or lower current or voltage to the light-emitting devices of the region A than to the other light-emitting devices.

Figure 4A:
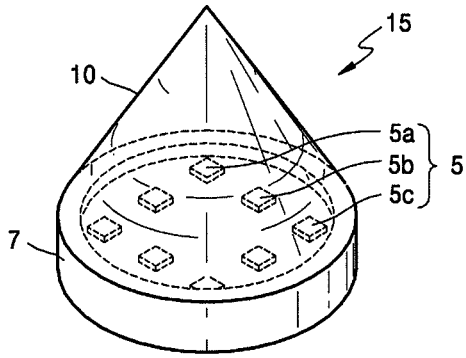
FIG. 4A is a perspective view of the light-emitting device used in the display and the backlight unit according to an exemplary embodiment of the present invention.
Figure 4B:
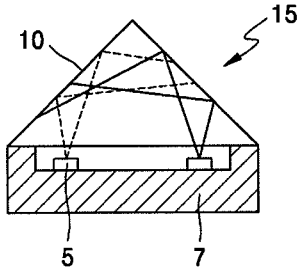
FIG. 4B is a sectional view of the light-emitting device shown in FIG. 4A.

Referring to FIGS. 4A and 4B, the light-emitting devices 15 may be a multi chip light-emitting device where a plurality of LED chips 5 emitting light with at least two wavelength ranges are configured in one package. Also, the light-emitting device 15 includes a cap 10 for total reflection of the light emitted from the LED chips 5. The light-emitting devices 15 generate a white light by totally reflecting the light with different wavelengths several times in the LED chips 5 and mixing the light.

In the light-emitting device 15, the LED chips 5 are arranged on a base 7, and the cap 10 is located above the LED chips 5. The LED chips 5 emit light with at least two different wavelength ranges. For example, the LED chips 5 may include a first LED chip 5*a* emitting light with a red wavelength range, a second LED chip 5*b* emitting light with a green wavelength range, and a third LED chip 5*c* emitting light with a blue wavelength range. In FIG. 4A, the light-emitting device 15 includes eight LED chips: three first LED chips 5*a*, two second LED chips 5*b*, and three third LED chips 5*c*. The number or arrangement of LED chips 5 in each wavelength range can be properly determined according to desired color temperature ranges in consideration of an amount of light emitted from LED chips 5 in each wavelength. Thus, although the light-emitting devices 15 are configured in a multi-chip structure, the size of the multi-chip structure does not vary remarkably in comparison with a single-chip structure, so that the size of the light-emitting devices 15 does not increase. In addition, since colors are mixed into a white light in the light-emitting device, a space for mixture becomes smaller. Consequently, a thickness of the backlight unit can be reduced.

The cap 10 is formed of transparent materials, for example, a lens. The cap 10 is formed of materials having a larger refractive index than a medium between the light-emitting device 15 and the diffusion plate 40 so as to satisfy the condition for a total reflection. For example, when air is a medium between the light-emitting device 15 and the diffusion plate 40, the cap 10 can be formed of epoxy resin or poly-methyl methacrylate (PMMA), which has a refractive index of 1.49. Since the cap 10 has a larger refractive index than air, the cap 10 totally reflects several times the light that is projected at a larger angle than a critical angle on its boundary. Light from the light-emitting devices 15 is mixed in the cap 10 and emitted as a white light. Thus, because the different wavelengths of light are mixed in the cap 10 and emitted from the light-emitting diode units toward the diffusion plate 40, there is no need to mix light between the light-emitting devices 15 and the diffusion plate 40. Therefore, a distance between the light-emitting devices 15 and the diffusion plate 40 can be shortened.

The cap 10 may be formed in a cone shape, a dome shape or a poly-pyramid shape. In FIGS. 4A and 4B, the cap 10 is formed in a cone shape.

Since the LED chips 5*a*, 5*b* and 5*c* may be disposed not at the center but at the periphery of the base 7, the generation of a bright light spot can be prevented. The bright light spot is a phenomenon in which a relatively bright spot is produced because the light from the light-emitting device 15 is irregularly diffused and then is projected with a relatively high brightness. This bright light spot is one of factors which results in a low picture quality. When light is emitted from the LED chip 5 located at the center of the base 7, most of the light is projected toward an apex of the cap 10 and transmitted without total reflection. That is, if the LED chip 5 is located at the center of the base 7 opposite to the center of the cap 10, most of the light emitted from the light-emitting device is incident at a smaller angle than the critical angle of the cap 10. Thus, the light goes straight through the cap 10 or is refracted. On the other hand, if the LED chip 5 is located at the periphery of the base 7, most of the light emitted from the LED chip 5 is incident at a larger angle than the critical angle of the cap 10 and is totally reflected inside.

Figure 5:
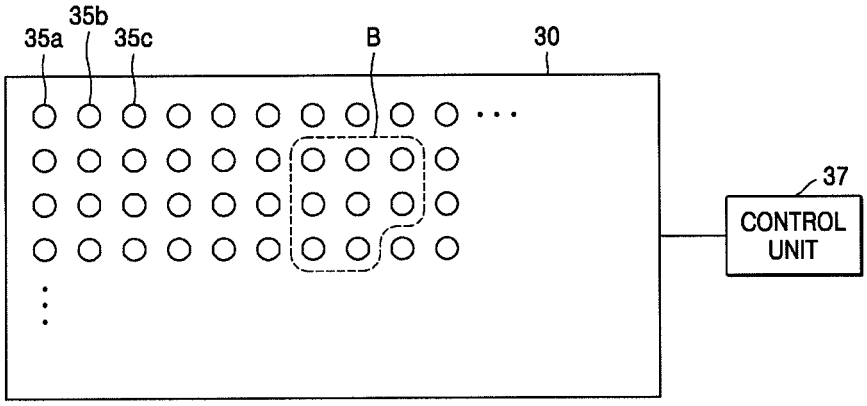
FIG. 5 is a view illustrating the arrangement of single-chip light-emitting devices used in a display and a backlight unit according to an exemplary embodiment of the present invention.

Meanwhile, the light-emitting device 15 can be formed within a single chip and the light-emitting devices emitting light with different wavelengths can be arranged in turn. As shown in FIG. 5, a first light-emitting device 35*a* emitting light with a first wavelength, a second light-emitting device 35*b* emitting light with a second wavelength, and a third light-emitting device 35*c* emitting light with a third wavelength are alternately arranged on a PCB substrate 30. Meanwhile, in some cases, when it is necessary to provide light with wavelength needing a greater light intensity than that of other light, two chips emitting light needing the greater light intensity can be arranged consecutively. For example, an amount of a green light can be supplemented by arranging a red light-emitting device, a green light-emitting device, a green light-emitting device, and a blue light-emitting device in sequence.

As described above, the single-chip light-emitting devices 35*a*, 35*b* and 35*c* are driven electrically and separately through a control unit 37 on the PCB substrate 30.

For example, the brightness of the light-emitting devices included in a region B of FIG. 5 can be increased or decreased more than that of the other light-emitting devices by supplying a relatively higher or lower current or voltage to the light-emitting devices of the region B than to the other light-emitting devices. Accordingly, a more dynamic image can be provided.

Figure 6:
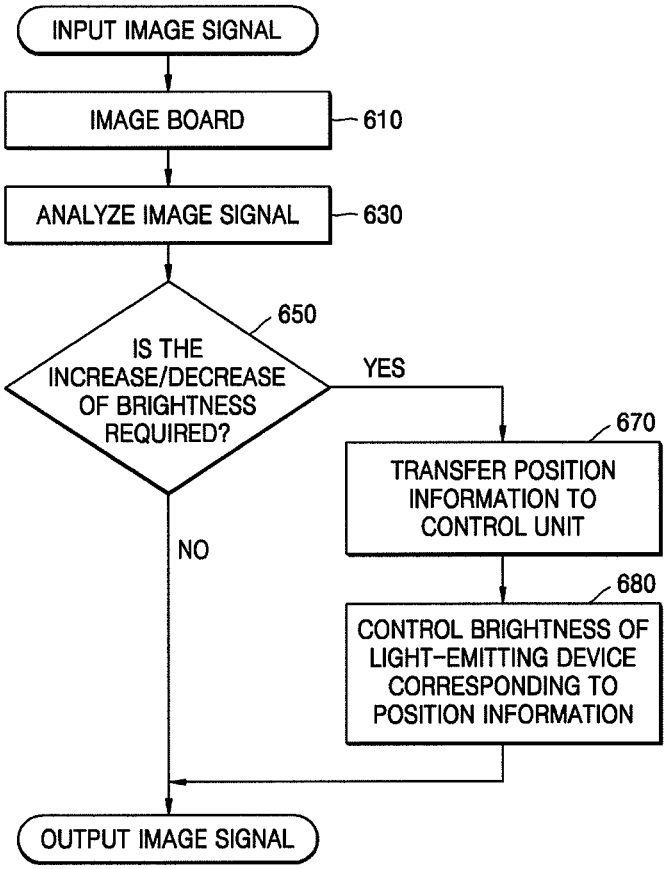
FIG. 6 is a flowchart illustrating the process of forming an image in the display according to an exemplary embodiment of the present invention.
Figure 7:
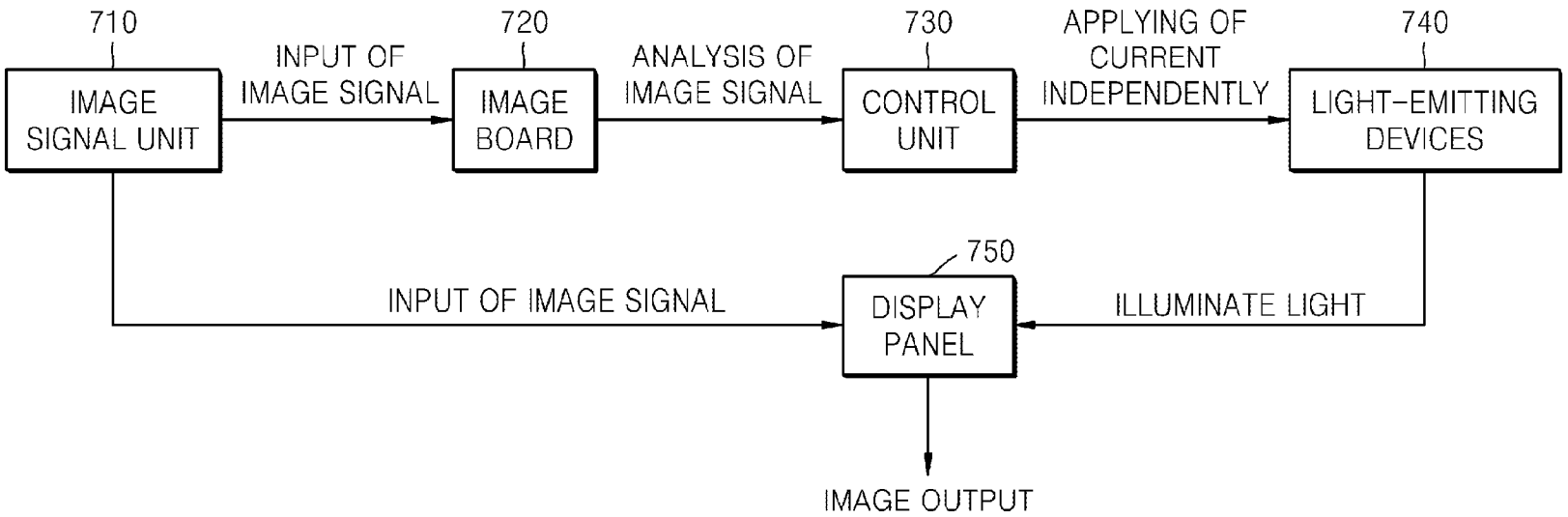
FIG. 7 is a block diagram of the display according to an exemplary embodiment of the present invention.

FIG. 6 is a flowchart illustrating a process of forming an image in the display according to an exemplary embodiment of the present invention. Further, FIG. 7 is a block diagram of the display according to an exemplary embodiment of the present invention. In Operation 610, an image signal unit 710 inputs an image signal to an image board 720. In Operations 630 and 650, the image board 720 analyzes the image signal and determines whether the image requires an increase or decrease to the brightness. A reference value that is used for determining the increase and decrease of the brightness is stored in the image board 720, and information of a region that requires an increase or decrease to the brightness is extracted from the reference value. In Operation 670, in the case of an explosion scene or firework scene, for example, the brightness must be partially increased more than in the other regions of the display. Conversely, in the case of a starlit night sky, the brightness as a background must be decreased relative to other regions. In these cases, position information of the corresponding regions is transferred to a control unit 730. In Operation 680, the control unit 730 adjusts the brightness of the light-emitting devices by controlling a driving current and/or voltage of each of light-emitting devices 740 in the region that corresponds to the position information. Next, a display panel 750 performs a space modulation on the light emitted from the light-emitting devices 740 according to the image signal that is input from the image signal unit 710 and then outputs the resulting image. As described above, according to an exemplary embodiment of the present invention, a realistic image is provided by controlling a brightness of light-emitting devices that correspond to the region that requires an increase or decrease of brightness.

According to an exemplary embodiment of the present invention, the light-emitting devices can be independently driven and controlled. Therefore, the images that are subject to partial increase or decrease of the brightness can be displayed more dynamically and realistically by controlling the current applied to the light-emitting devices.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A backlight unit comprising:

a plurality of light-emitting devices which are disposed in a plurality of regions on a substrate, wherein the light-emitting devices are controlled with respect to each of the plurality of regions and each of the light-emitting devices comprises a cap and a plurality of light-emitting device chips emitting light having at least two wavelength ranges within the cap, and emits white light by totally reflecting the light having the at least two wavelength ranges and mixing the light having the at least two wavelength ranges within the cap;

an image board which has a reference value and analyzes an image signal which is input by an image signal unit by comparing the image signal with the reference value, thereby obtaining position information corresponding to a region having a relatively higher or lower brightness than the reference value; and a control unit which controls a brightness of the light-emitting devices located in the region corresponding to the position information obtained by the image board, wherein light-emitting devices located in a same region are driven together and light-emitting devices located in different regions are separately driven, wherein each of the plurality of light-emitting devices further comprises a base and a plurality of light-emitting device chips disposed on only a periphery of the base, and wherein the plurality of light-emitting device chips disposed on only the periphery of the base include at least two first type light-emitting device chips each having a first wavelength range, at least two second type light-emitting device chips each having a second wave length range and at least two third type light-emitting device chips each having a third wave length.

2. The backlight unit of claim 1, wherein the control unit controls the brightness of the light-emitting devices by adjusting at least one of a voltage and a current which is applied to the light-emitting devices.

3. The backlight unit of claim 1, wherein the cap has a larger refractive index than a refractive index of an adjacent external medium.

4. The backlight unit of claim 1, wherein the cap has a cone shape that has a circular base and a curved side tapering to a point without a planar side in the curved side.

5. A backlight unit comprising:

a plurality of light-emitting devices, wherein each of the light-emitting devices comprises a cap and a plurality of light-emitting device chips emitting light having at least two wavelength ranges within the cap, and emits white light by totally reflecting the light having the at least two wavelength ranges and mixing the light having the at least two wavelength ranges within the cap;

an image board which has a reference value and analyzes an image signal which is input by an image signal unit by comparing the image signal with the reference value, thereby obtaining position information corresponding to a region having a relatively higher or lower brightness than the reference value; and a control unit which controls a brightness of the light-emitting devices located in the region corresponding to the position information obtained by the image board, wherein light-emitting devices located in a same region are driven together and light-emitting devices located in different regions are separately driven, wherein each of the plurality of light-emitting devices further comprises a base and a plurality of light-emitting device chips disposed on only a periphery of the base, and wherein the plurality of light-emitting device chips disposed on only the periphery of the base include at least two first type light-emitting device chips each having a first wavelength range, at least two second type light-emitting device chips each having a second wave length range and at least two third type light-emitting device chips each having a third wave length.

6. The backlight unit of claim 5, wherein the control unit controls the brightness of the light-emitting devices by adjusting at least one of a voltage and a current which is applied to the light-emitting devices.

7. The backlight unit of claim 5, wherein the control unit drives the light-emitting devices separately.

8. The backlight unit of claim 5, wherein the control unit controls a plurality of adjacent light-emitting devices together.

9. The backlight unit of claim 5, wherein the image board uses a reference value for evaluating brightness.

10. The backlight unit of claim 5, wherein the cap has a larger refractive index than a refractive index of an adjacent external medium.

11. The backlight unit of claim 5, wherein the cap has a cone shape that has a circular base and a curved side tapering to a point without a planar side in the curved side.

12. A display device comprising:

a plurality of light-emitting devices which are disposed in a plurality of regions on a substrate, wherein the light-emitting devices are controlled with respect to each of the plurality of regions and each of the light-emitting devices comprises a cap and a plurality of light-emitting device chips emitting light having at least two wavelength ranges within the cap, and emits white light by totally reflecting the light having the at least two wavelength ranges and mixing the light having the at least two wavelength ranges within the cap;

an image board which has a reference value and analyzes an image signal which is input by an image signal unit by comparing the image signal with the reference value, thereby obtaining position information corresponding to a region having a relatively higher or lower brightness than the reference value; and a display panel which forms an image using light emitted from the light-emitting devices and the image signal from the image signal unit, wherein light-emitting devices located in a same region are driven together and light-emitting devices located in different regions are separately driven, wherein each of the plurality of light-emitting devices further comprises a base and a plurality of light-emitting device chips disposed on only a periphery of the base, and wherein the plurality of light-emitting device chips disposed on only the periphery of the base include at least two first type light-emitting device chips each having a first wavelength range, at least two second type light-emitting device chips each having a second wave length range and at least two third type light-emitting device chips each having a third wave length.

13. The display device of claim 12, wherein the cap has a cone shape that has a circular bottom and a curved side tapering to a point without a planar side in the curved side.

14. A display device comprising:

a plurality of light-emitting devices, wherein each of the light-emitting devices comprises a cap and a plurality of light-emitting device chips emitting light having at least two wavelength ranges within the cap, and emits white light by totally reflecting the light having the at least two wavelength ranges and mixing the light having the at least two wavelength ranges within the cap;

an image board which has a reference value and analyzes an image signal which is input by an image signal unit by comparing the image signal with the reference value, thereby obtaining position information corresponding to a region having a relatively higher or lower brightness than the reference value;

a control unit which controls a brightness of the light-emitting devices located in the region corresponding to the position information obtained by the image board; and a display panel which forms an image using light emitted from the light-emitting devices, wherein light-emitting devices located in a same region are driven together and light-emitting devices located in different regions are separately driven, wherein each of the plurality of light-emitting devices further comprises a base and a plurality of light-emitting device chips disposed on only a periphery of the base, and wherein the plurality of light-emitting device chips disposed on only the periphery of the base include at least two first type light-emitting device chips each having a first wavelength range, at least two second type light-emitting device chips each having a second wave length range and at least two third type light-emitting device chips each having a third wave length.

15. The display device of claim 14, wherein the cap has a cone shape that has a circular bottom and a curved side tapering to a point without a planar side in the curved side.

16. A method of displaying a dynamic image, the method comprising:

analyzing an image signal which is input by an image signal unit by comparing the image signal with a reference value;

collecting brightness information of an image from the image signal;

obtaining a brightness deviation having a relatively higher or lower brightness than the reference value from the brightness information;

obtaining position information of a display panel corresponding to the brightness deviation;

controlling a brightness of light-emitting devices located in a region corresponding to the position information, wherein light-emitting devices located in a same region are driven together and light-emitting devices in different regions are separately controlled and each of the light-emitting devices comprises a cap and a plurality of light-emitting device chips emitting light having at least two wavelength ranges within the cap, and emits white light by totally reflecting the light having the at least two wavelength ranges and mixing the light having the at least two wavelength ranges within the cap, wherein each of the light-emitting devices further comprises a base and a plurality of light-emitting device chips disposed on only a periphery of the base, and wherein the plurality of light-emitting device chips disposed on only the periphery of the base include at least two first type light-emitting device chips each having a first wavelength range, at least two second type light-emitting device chips each having a second wave length range and at least two third type light-emitting device chips each having a third wave length.

17. The method of claim 16, wherein the controlling the brightness of the light-emitting devices comprises controlling the brightness of the light-emitting devices by adjusting at least one of a voltage and a current which is applied to the light-emitting devices.

18. The method of claim 16, wherein the cap has a larger refractive index than a refractive index of an adjacent external medium and totally reflects incident light.

19. The method of claim 16, wherein the brightness information is brightness information corresponding to a plurality of regions.

20. The method of claim 16, wherein the light-emitting devices are located in a plurality of regions, and light-emitting devices located in a same region are driven together and light-emitting devices located in different regions are separately driven.

21. The method of claim 16, wherein the obtaining the position information comprises obtaining position information corresponding to a region requiring a relative increase or decrease of brightness.

22. The method of claim 16, wherein the collecting the brightness information comprises analyzing the image signal to determine whether there is a region of the image requiring a relative increase or decrease of brightness.

23. The method of claim 16, wherein, in the obtaining the brightness deviation, information corresponding to a region requiring a relative increase or decrease of brightness is obtained based on the reference value.

24. The method of displaying a dynamic image of claim 16, wherein the has cone shape that has a circular bottom and a curved side tapering to a point without a planar side in the curved side.

* * * * *